US005135423A

United States Patent [19]

Chung

[11] Patent Number: 5,135,423

[45] Date of Patent: Aug. 4, 1992

[54] PORTABLE TOY FOR PLAYING DIFFERENT, INTERCHANGEABLE ELECTRO-MECHANICAL TOY UNITS

[75] Inventor: Henry Chung, Toronto, Canada

[73] Assignee: Playtoy Industries, a Partnership, Toronto, Canada

[21] Appl. No.: 641,052

[22] Filed: Jan. 14, 1991

[30] Foreign Application Priority Data

Jan. 25, 1990 [CA] Canada ..... 2.008/604

[51] Int. Cl.[5] ..... A63H 33/26

[52] U.S. Cl. ..... 446/26; 446/484; 446/397; 446/485; 273/336; 273/85 R

[58] Field of Search ..... 446/26, 484, 485, 456, 446/91, 90, 438, 397, 358; 273/85 R, 336, DIG. 19

[56] References Cited

U.S. PATENT DOCUMENTS

| | | | |
|---|---|---|---|
| 3,553,885 | 1/1971 | Tazaki | 446/485 X |
| 3,664,670 | 5/1972 | Glass et al. | 446/484 X |
| 3,953,935 | 5/1976 | Reiner et al. | 446/26 |
| 4,109,398 | 8/1978 | Hida | 446/91 X |
| 4,406,085 | 9/1983 | Rhodes | 446/456 |
| 4,473,969 | 10/1984 | Wilson | 446/26 |
| 4,571,199 | 2/1986 | Murakami | 446/26 X |
| 4,756,703 | 7/1988 | Kennedy et al. | 446/26 |
| 4,820,229 | 4/1989 | Spraggins | 446/26 |

FOREIGN PATENT DOCUMENTS 8302566 8/1983 World Int. Prop. O. .

*Primary Examiner*—Mickey Yu

*Attorney, Agent, or Firm*—Riches, McKenzie & Herbert

[57] ABSTRACT

This invention relates to a portable toy capable of playing, at different times, different, interchangeable, electro-mechanical toy-units. The invention provides a toy which permits a user to have a single power-unit to supply electrical and mechanical energy to a toy-unit which is received by the power-unit. However, the toy-units are interchangeable and so the user can play, at different times, with several different toy units, with each different toy-unit providing a different toy with which the user can play. In a preferred embodiment of the invention, the power-unit is worn on a wrist of the user.

16 Claims, 5 Drawing Sheets

PORTABLE TOY FOR PLAYING DIFFERENT, INTERCHANGEABLE ELECTRO-MECHANICAL TOY UNITS

BACKGROUND OF THE INVENTION

This invention relates to a portable toy for playing, at different times, interchangable, electro-mechanical toy-units. In particular, the invention relates to such a toy that is releasably-connected to a wrist of a user, particularly a child.

In the past, there have been portable toys and even games that are releasably connected to the user's wrist. However, each of these prior art toys was limited to one specific game, or type of game, that could be played. Moreover, the type of game involved either a mechanical game or an electronic game, but not an electro-mechanical game.

SUMMARY OF THE INVENTION

Accordingly, it is an object of this invention to provide a portable toy for playing, at different times, different, interchangable, electro-mechanical toy-units.

It is a further object of this invention to provide such a toy that may be releasably-connected to a wrist of a user.

Accordingly, in one of its broad aspects, this invention resides in providing a portable toy capable of playing, at different times, interchangable electro-mechanical toy-units, comprising: a power unit comprising: a power-unit chassis; an electrical energy source; a mechanical energy source energized by the electrical energy source; first power-unit mechanical energy transferring means for transferring mechanical energy from the mechanical energy source to a first power-unit mechanical energy coupling means; first power-unit electrical energy contacting means; first power-unit electrical energy conducting means for conducting electrical energy from the electrical energy source to the first power-unit electrical contacting means; toy-unit receiving means for removeably receiving one toy-unit at a time which may be selected from a plurality of different, interchangable electro-mechanical toy-units; and a toy-unit having: a toy-unit chassis; first, mechanical toy-element visible from outside the toy-unit chassis; first toy-unit mechanical energy coupling means; first toy-unit mechanical energy transferring means for transferring mechanical energy from the first toy-unit mechanical energy coupling means to the first mechanical toy-element for imparting mechanical movement to the first toy-element; toy-unit controlling means for user-controlling at least a part of the mechanical movement of the first toy-element; first toy-unit electrical contacting means; and first toy-unit electrical conducting means for conducting electrical energy from the first toy-unit electrical contacting means to the toy-unit controlling means; and wherein the power-unit has a configuration and the toy-unit has a configuration such that when the toy unit is removeably received by the power unit: the first toy-unit mechanical energy coupling means is mechanically coupled to the first power-unit mechanical energy coupling means; and the first toy-unit electrical energy contacting means is electrically contacted with the first power-unit electrical energy contacting means.

Further aspects of the invention will become apparent upon reading the following detailed description and the drawings which illustrate the invention and embodiments of the invention.

DETAILED DESCRIPTION OF THE INVENTION AND PREFERRED EMBODIMENTS THEREOF

Figure 1:
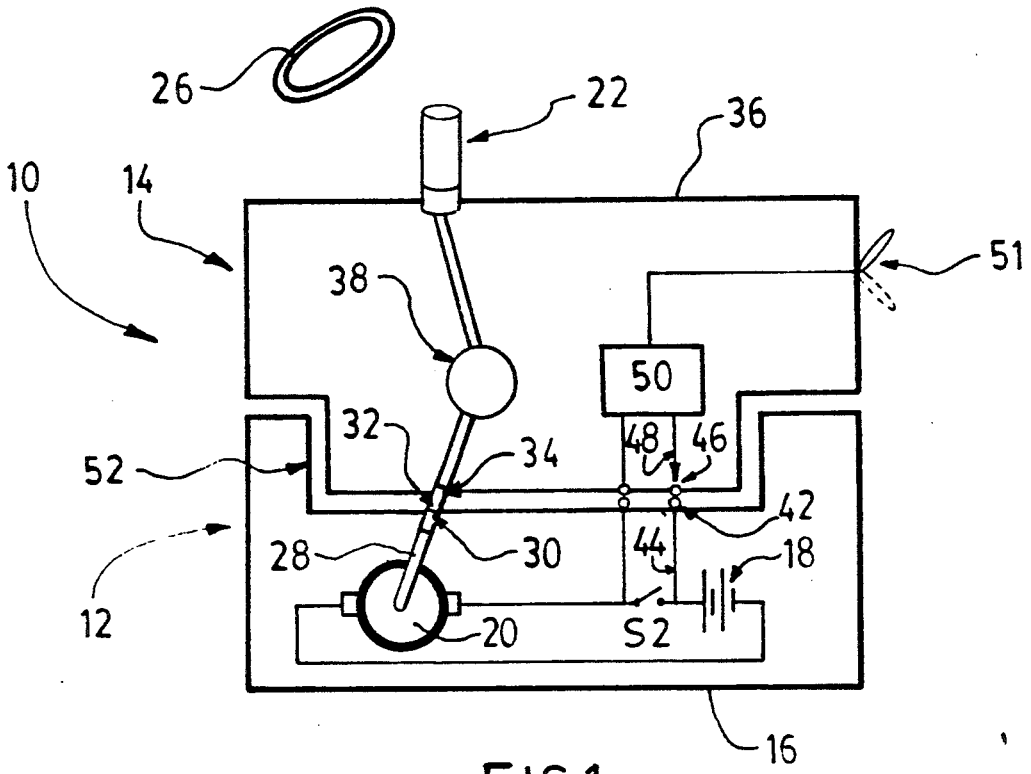
FIG. 1 is a schematic, side-view representation of a general embodiment of the invention.

With reference to FIG. 1, a schematic representation of a portable toy 10 may be seen. The portable toy 10 has a power-unit 12 and a toy-unit 14 which is received by the power-unit 12. The power-unit 12 and the toy-unit 14 as shown in FIG. 1 are intended only to be representative of the general concepts of each unit.

Power-unit 12 will receive different toy-units 14, one-at-a-time and at different times, so as to allow the user to play different toys with the same power-unit 12. All toy-units 14 are configured to be received by the power-unit 12 and to receive electrical and mechanical energy from the power-unit 12. However, each toy-unit 14 provides a different electro-mechanical toy with which the user may play. Thus, by changing the interchangable toy-units 14, the user may play, at different times, with different, interchangable, electro-mechanical toys.

The power-unit 12 of the toy 10 has a power-unit chassis 16 on which are mounted, either directly or indirectly, the elements of the power-unit 12.

The power-unit 12 has an electrical power source 18 which is preferably one or two batteries 18A and 18B (see FIG. 6) which are positioned below sliding battery doors 18A' and 18B'.

Batteries 18 are electrically connected, either directly in the power-unit 12 or indirectly through the toy-unit 14, to a mechanical energy source 20, preferably an electrical motor 20. The batteries 18 energize the motor 20.

The batteries 18 and the motor 20 in the power-unit 12 are used to activate the toy-elements of the toy-unit 14, for example, first mechanical toy-element 22 on the toy-unit 14. Because each toy-unit 14 will provide a different toy or even type of toy, each toy-unit 14 might be any sort of toy-unit that conforms to the general requirements of the invention. It will be understood that all possible variations of the toy-unit 14 cannot be described herein, although all possible variations of the toy-units 14 that conform to or comply with the general requirements of the invention do fall within the scope of the invention. Accordingly, all mechanical toy-elements 22 of toy-unit 14 cannot be described.

Figure 2:
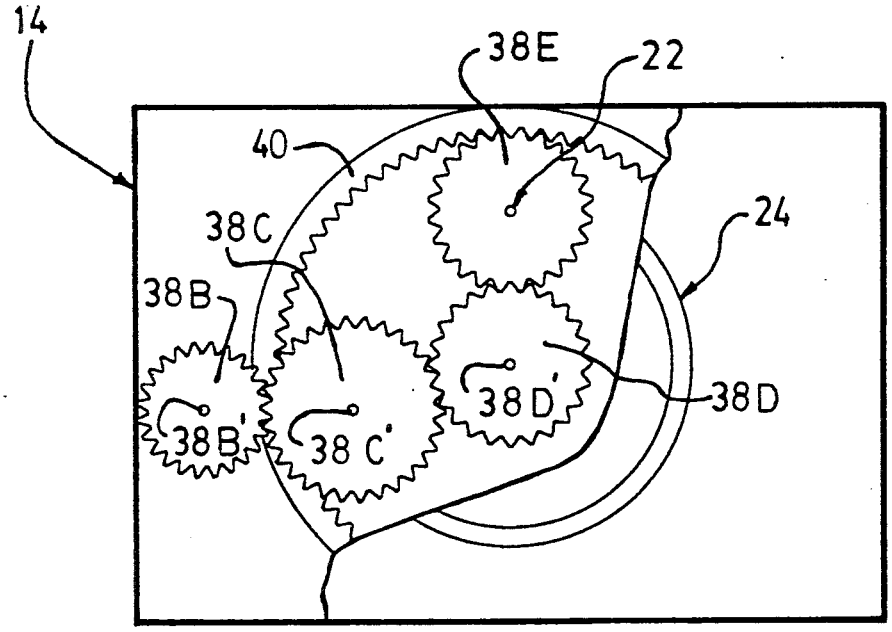
FIG. 2 is a schematic, break-away, top-view representation of one embodiment of the invention.
Figure 3:
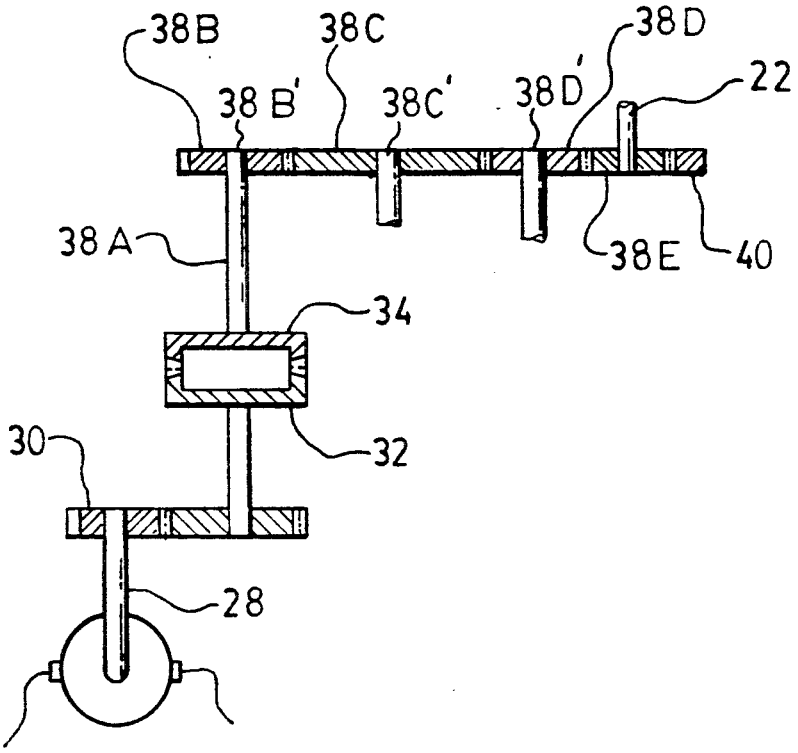
FIG. 3 is a schematic, side view, partial representation of an embodiment of the invention.

By way of example only, toy-element 22 shown in FIGS. 1, 2 and 3 is a ring-toss post 22. The game that is played with toy-unit 14 shown in these FIGS. 1, 2 and 3 is ring-toss. As ring-toss post 22 moves around the track 24, (as seen in FIG. 2), the user attempts to throw rings 26 over the post 22 (FIG. 1). Preferably, post 22 is foldable so that when the toy-unit 14 is not in use, the post 22 can be folded down to make the toy-unit more suitable for storage.

The batteries 18 and the motor 20 are used to ultimately mechanically move the post 22 around the track 24 so that it is more challenging for the user to throw the rings 26 over the post 22.

The toy element (generally 22) is ultimately mechanically linked to the motor 20. The motor 20 through its shaft 28 is mechanically connected to a power-unit mechanical energy transferring means 30 which may be either rotary or linear, or both. For example, gears, worms, ratchets, pinions, racks or rockers may be used, or any useful combination of these. The power-unit mechanical energy transferring means 30 shown in FIG. 3 is a speed-reduction gear 30. The power-unit mechanical energy transferring unit means 30 is connected to a power-unit mechanical energy coupling means 32. The power-unit mechanical energy transferring means 30 and the power-unit mechanical energy transferring means 32 are shown only symbolically in FIG. 1.

When the toy-unit 14 is properly received by the power-unit 12, the power-unit mechanical energy coupling means 32 is mechanically coupled with a mechanical energy coupling means 34 on the toy-unit 14. The coupling means 32 and 34 can be any suitable combination of mechanical coupling devices. In FIG. 3, each of coupling means 32 and 34 is an intermeshing gear.

For simplicity, it is possible that the power-unit mechanical energy transferring means 30 and the power-unit mechanical energy coupling means 32 are the same device, for example, a single gear 32. In that case, speed reduction gear 30 would not necessarily be used and the power-unit mechanical energy transferring means 30 would be the coupling gear 32.

In the toy-unit 14, the elements of the toy-unit 14 are mounted, directly or indirectly, on the toy-unit chassis 36.

The toy-unit mechanical energy coupling means 34 is mechanically connected to the toy element 22 through toy-unit mechanical energy transferring means 38. The toy-unit mechanical energy transferring means 38 may be either rotary or linear, or both. For example, gears, worms, ratchets, pinions, racks or rockers may be used, or any useful combination of these.

In a preferred embodiment of the invention, there are two power-unit mechanical energy coupling means 32 and two respective toy-unit mechanical energy coupling means 34 so that mechanical energy in two forms is transferred to the toy-unit 14. The two forms could be simply by gears of different sizes so that the rotary speeds were different or it could be that one form was rotary and the other form was linear.

The toy-unit mechanical energy transferring means 38 shown in FIGS. 2 and 3 is a series of elements comprising shaft 38A transferring the mechanical energy from the lower portion of the toy-unit 14 (which is exposed to and in contact with the power-unit 12) to the upper portion of the toy-unit 14 (which is exposed to the view of the user); outer horizontal gear 38B, middle horizontal gear 38C and inner horizontal gear 38D. Each of gears 38B, 38C and 38D rotates around a fixed axis 38B', 38C' and 38D', respectively, and each is meshed as shown in FIGS. 2 and 3.

Rotating gear 38E is meshed with horizontal gear 38D and outer geared ring 40. Thus, when the motor 20 is running, the mechanical energy from the motor 20 is transferred to gear 38E causing it to move around in a circle about gear 38D. Post 22 is attached to gear 38E. Therefore, as gear 38E rotates around gear 38D, post 22 moves around the top face of the toy-unit 14 along track 24 shown in FIG. 3. As the post 22 move around the face of the toy-unit 14, the user can throw rings 26 at the moving post 22 to play with the toy. Thus, ultimately, the motor 20 imparts at least some mechanical movement to toy-element (post) 22.

In some toy-units 14, some of the mechanical movement of the toy-elements 22 may come from the user.

Figure 5:
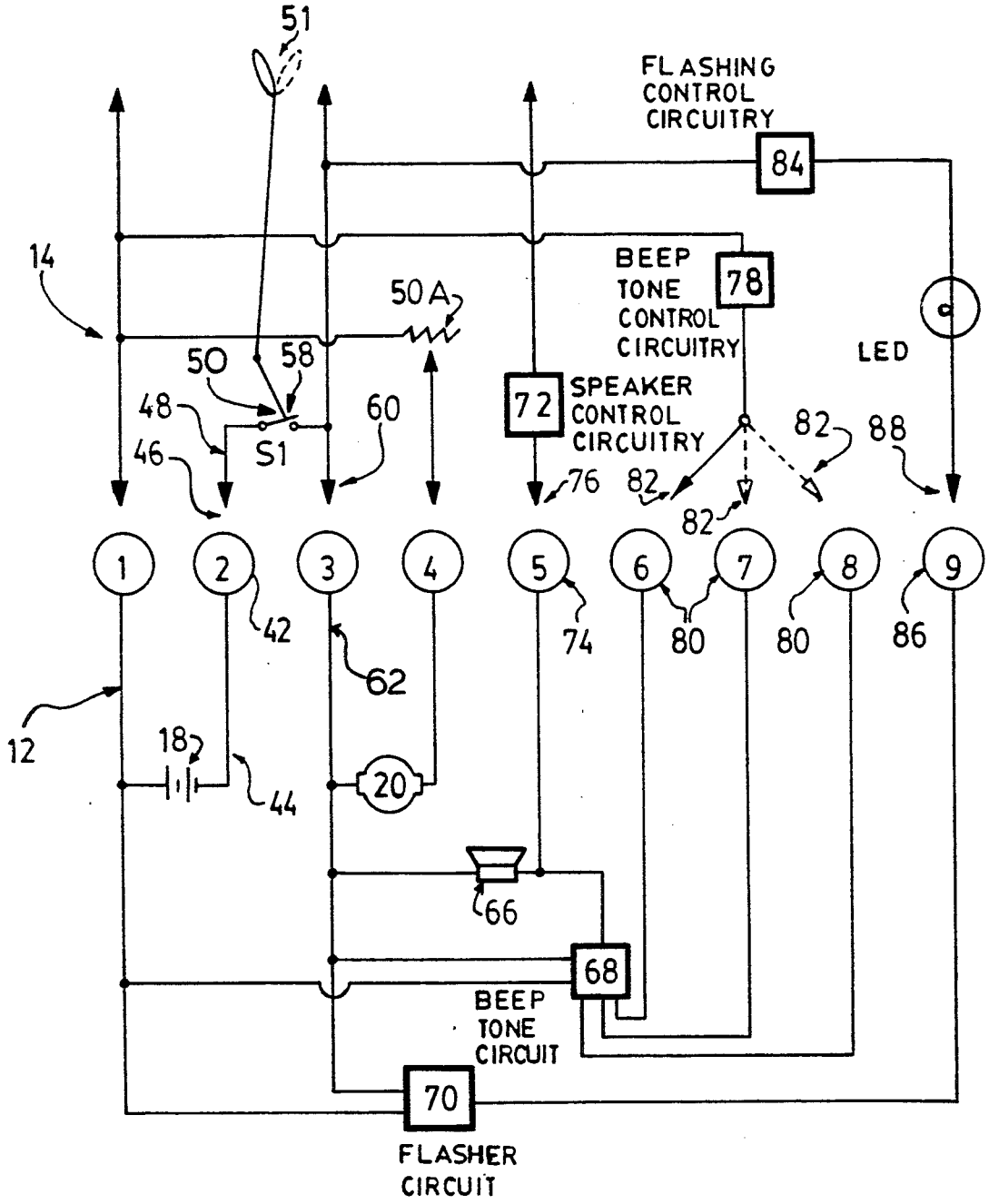
FIG. 5 is a schematic circuit diagram, of one embodiment of the invention.

The electrical energy source (batteries) 18 is connected to the motor 20. Preferably, this connection is indirectly through the toy-unit 14 as shown in FIG. 5.

On the power-unit 12 is a power-unit electrical contacting means 42 which is connected electrically to the power-unit electrical conducting means 44 (see FIG. 5).. Power-unit electrical conducting means 44 is electrically connected to the batteries 18 for conducting electrical energy from the batteries 18 to the power-unit electrical contacting means 42.

When the toy-unit 14 is properly received by the power-unit 12, the power-unit electrical contacting means 42 is in electrical contact with the toy-unit electrical contacting means 46. Thus, electrical energy is conducted from the batteries 18 to the toy-unit contacting means 46 and then from there through the toy-unit electrical conducting means 48 to the first toy-unit controlling means 50 for controlling at least a part of the mechanical movement imparted to the toy element 22. In this particular embodiment being described, the controlling means 50 controls whether or not the motor 20 is ON or OFF.

The controlling means 50 is activated by the user of the toy 10. In this particular embodiment, the controlling means 50 includes a two-position toggle 51 which is thrown into on position by the user to put the motor 20 into the ON state. The toggle 51 is thrown into its other position to put the motor 20 into the OFF state.

The controlling means 50 in this particular embodiment may include a switch S1 which opens and closes to put the motor 20 into the ON or OFF state (this embodiment is described in greater detail further below). Alternatively, the controlling means 50 may create an electrical signal which is sent to the power unit 12 to activate a switch on the power-unit 12 which will open and close to put the motor 20 into the ON or OFF state.

In other embodiments of the invention, the controlling means 50 may be more sophisticated and complex such as 50A, in order to control other functions, such as the speed of the motor 20, and also indirectly the mechanical movement or activation of toy-elements 22. On toy-units 14 that are more complicated than the example described herein, there may be two or more toy-elements 22.

The power-unit 12 and the toy-unit 14 each has a certain respective configuration as to shape and location of some elements. These configurations correspond to each other to the extent to permit, when the toy unit 14 is properly received by the power-unit 12, the power-unit mechanical energy coupling means 32 to be mechanically coupled with the toy-unit mechanical energy coupling means 34, and the power-unit electrical energy contacting means 42 to be electrically contacted with the toy-unit electrical energy contacting means 46.

The power-unit 12 has a receiving means 52 for receiving the toy-unit 14. Preferably, the receiving means 52 is located at the top portion of the power-unit 12. Preferably, the receiving means 52 is a recess 52 at the top portion of the power-unit 12 to receive the toy-unit 14. However, it would be possible for the toy-unit 14 to be received without a recess 52. The power-unit electrical contacting means 42 and the power-unit mechanical energy coupling means 32 are located preferably in the recess 52 of the power-unit 12.

In a preferred embodiment of the invention, power-unit 12 is to be worn about the user's wrist, most likely a child's wrist. There is a releasably-connecting means 54 attached to the power-unit 12 for releasably connecting the power-unit 12 to the user's wrist. Preferably, the releasably-connecting means 54 is a strap, or two straps, that is releasably-connected by means of a buckle, button or VELCRO touch fastener (VELCRO is a registered trade mark of Velcro USE Inc.).

When the toy 10 is not worn on the wrist, there is a good likelihood that the toy 10 will usually remain level. Therefore, it is not necessary that the toy-unit 14 be secured to the power-unit 12 in order to prevent the toy-unit 14 from moving with respect to the power-unit 12. On the other hand, when the toy 10 is worn on the wrist of the user, there is a much greater likelihood that the toy-unit 14 will not remain received by the power-unit 12. Therefore, in a further embodiment of the invention, the receiving means 52 includes a removably-securing means 56 for removably securing the toy-unit 14 to the power-unit 12.

Figure 4:
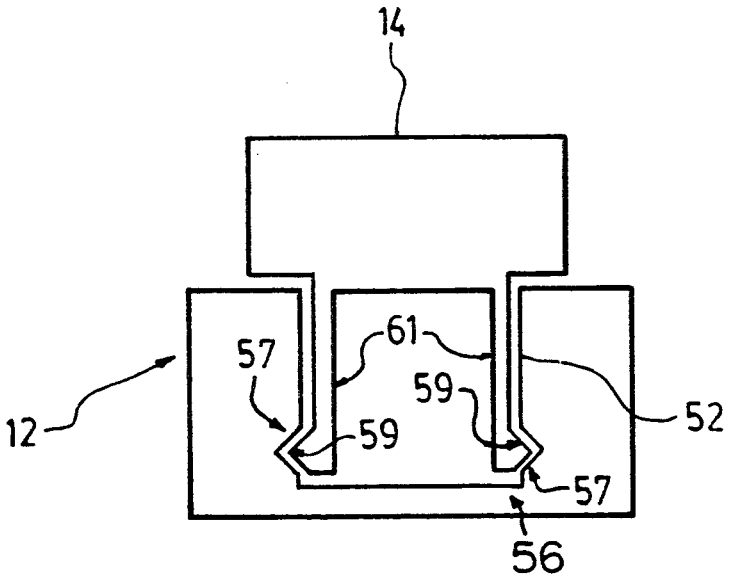
FIG. 4 is a schematic side view of one embodiment of the receiving means of the invention.

Preferably, the removably-securing means 56 include "V"-shaped recesses 57 or protrusions on the vertical walls of receiving means 52 to mesh with the corresponding protrusions 59 or recesses on the flexibly-resilient legs 61 depending from the lower region of toy-unit 14 as best seen in FIG. 4.

In a further preferred embodiment of the invention, the toy-unit controlling means 50 includes toy-unit power-ON/OFF electrical control circuitry 58 for controlling when the electrical energy to the motor 20 is either ON or OFF. This power-unit power-ON/OFF controlling circuitry 58 is electrically connected to a second toy-unit electrical contacting means 60.

Similarily, the power-unit 12 has a corresponding second power-unit electrical contacting means 62 that is shaped and positioned such that when the toy-unit 14 is received by the power-unit 12, the second power-unit electrical contacting means 62 is in electrical contact with the second toy-unit electrical contacting means 60.

The second power-unit electrical contacting unit means 62 is electrically connected to the motor 20.

In a further preferred embodiment of the invention, the power-unit 12 has any or all, or any combination, of the following: audio speaker 66; beep-tone circuit 68 and flashing means 70 as may been seen in the schematic diagram of the toy 10 shown in FIG. 5.

The audio speaker 66 will cause sounds to be made in accordance with control signals eminating from appropriate speaker control circuitry 72 on the toy-unit 14. There are appropriate power-unit and toy-unit electrical contacting means 74, 76 such that when the toy-unit 14 is received by the power-unit 12, the contacting means 74, 76 are in electrical contact.

Similarily, the beep-tone circuit 68 is made to produce different audio tones in accordance with control signals eminating from appropriate control circuitry 78 on the toy-unit 14. There are appropriate power-unit and toy-unit electrical contacting means 80, 82 such that when the toy-unit 14 is received the power-unit 12, the contacting means 80, 82 are in electrical contact.

Similarly, the flashing means 70 will create a flashing light effect, for example with LED's, either on the power-unit 12 or toy-unit 14, or both, in accordance with control signals eminating from appropriate control circuitry 84 on the toy-unit 14. There are appropriate power-unit and toy-unit electrical contacting means 86,88 such that when the toy-unit 14 is receiving the power-unit 12, the contacting means 86, 88 are in electrical contact.

Figure 6:
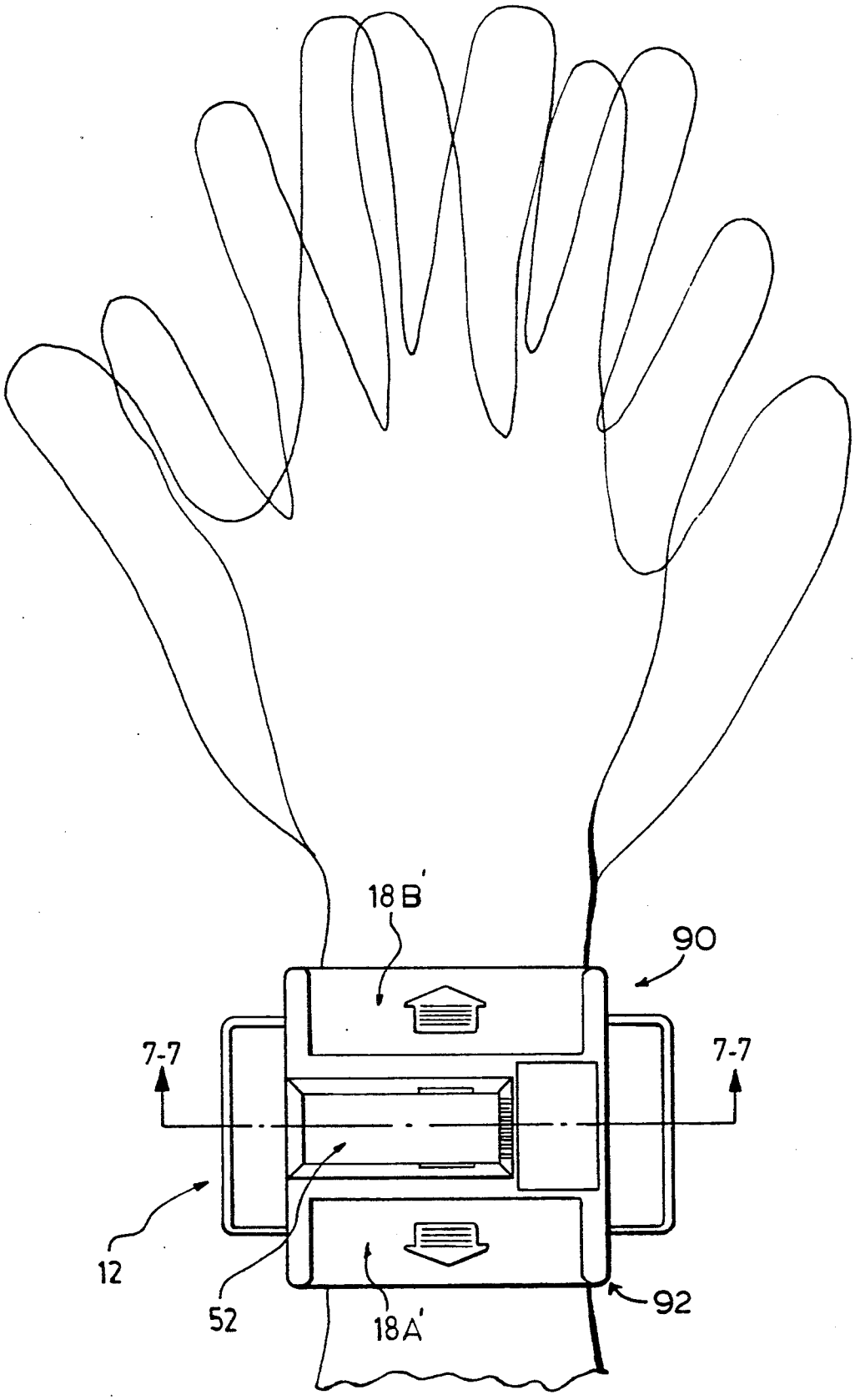
FIG. 6 is top-view of one embodiment of the invention.

In a further preferred embodiment of the invention, the two batteries 18A and 18B are located in the anterior portion 90 of the power-unit 12 and a posterior portion 92 of the power-unit 12 as shown in FIG. 6.

Figure 7:
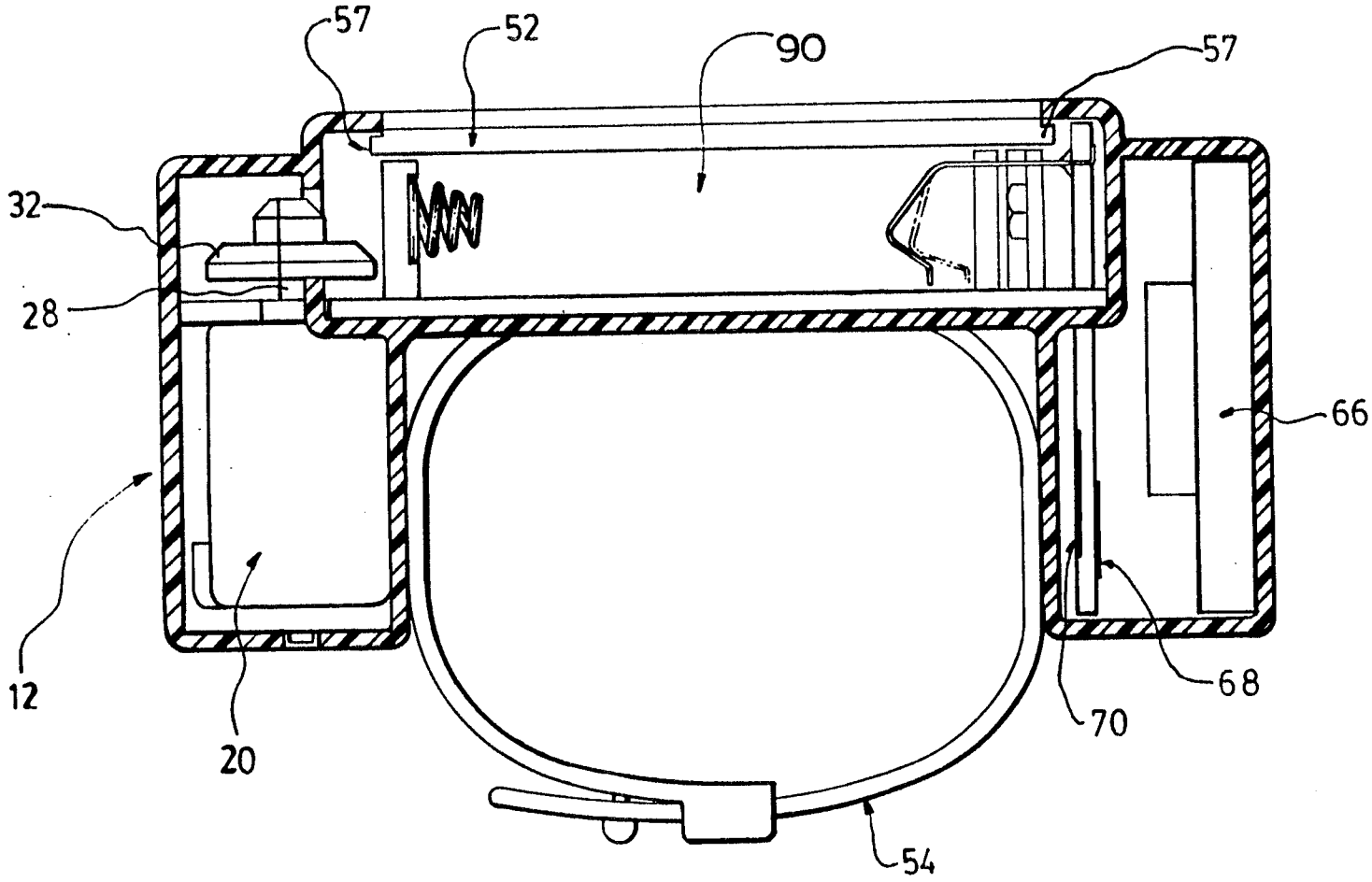
FIG. 7 is cross-sectional view looking along line 7—7 of FIG. 6.

Also, preferably, the power-unit is inverted-"U"-shaped in transverse cross-section as seen in FIG. 7. In that embodiment, the motor 20 is preferably positioned in the outer "finger" of the "U" in relation to the user's perspective. Also, the audio speaker 66, if there is one, may be positioned in the inner "finger". However, the positions of the motor 20 and the audio speaker 66 may be reversed.

The invention has been described in relation to a specific toy-unit 14. However, the invention includes and is intended to include any toy-unit 14 that can be functionally received by the power-unit 12 and provide a toy to be played by the user, whereby the toy-unit 14 receives its mechanical and electrical energy from the power-unit 12 whereby that mechanical energy is used at least in part to move a mechanical toy-element 22 and the electrical energy is also used to power the control circuitry 50 of the toy-unit 14 and whereby the user of the toy 10 activates and controls the operation of the toy-unit 14 by controls on the toy-unit 14.

Although the disclosure describes and illustrates preferred embodiments of the invention, it is to be understood that the invention is not restricted to these particular embodiments but includes functional equivalents of the described embodiments.

The embodiments of the invention in which an exclusive property or privilege is claimed are defined as follows:

1. A portable toy capable of playing, at different times, different, interchangeable electro-mechanical toy-units, comprising:

a power unit comprising:

a power-unit chassis;

an electrical energy source;

a mechanical energy source energized by the electrical energy source;

first power-unit mechanical energy transferring means for transferring mechanical energy from the mechanical energy source to a first power-unit mechanical energy coupling means;

first power-unit electrical energy contacting means;

first power-unit electrical energy conducting means for conducting electrical energy from the electrical energy source to the first power-unit electrical contacting means;

toy-unit receiving means for removably receiving one toy-unit at a time which may be selected from a plurality of different, interchangeable, electro-mechanical toy-units wherein the toy-unit receiving means includes removably securing means for interacting with the toy-unit to removably secure the toy-unit to the power-unit; and a releasably-connecting means for releasably connecting the power-unit to a wrist of a user; and a toy-unit comprising:

a toy-unit chassis;

first, mechanical toy-element visible from outside the toy-unit chassis;

first toy-unit mechanical energy coupling means;

first toy-unit mechanical energy transferring means for transferring mechanical energy from the first toy-unit mechanical energy coupling means to the first mechanical toy-element for imparting mechanical movement to the first toy-element;

toy-unit controlling means for user-controlling at least a part of the mechanical movement of the first toy-element;

first toy-unit electrical contacting means; and first toy-unit electrical conducting means for conducting electrical energy from the first toy-unit electrical contacting means to the toy-unit controlling means; and wherein the power-unit has a configuration and the toy-unit has a configuration such that when the toy-unit is removably received by the power-unit:

the first toy-unit mechanical energy coupling means is mechanically coupled to the first power-unit mechanical energy coupling means; and the first toy-unit electrical energy contacting means is electrically contacted with the first power-unit electrical energy contacting means.

2. A portable toy as defined in claim 1 wherein:

the toy-unit controlling means includes power-on/off electrical control circuitry electrically connected to a second electrical contacting means;

the power-unit has a second power-unit electrical contacting means electrically connected to power-on/off electrical control circuitry for controlling the energization of the mechanical energization means by the electrical energy source; and the configurations of the power-unit and the toy-unit are such that, when the toy-unit is received by the power-unit, the second toy-unit electrical contacting means is electrically contacted with the second power-unit electrical contacting means.

3. A portable toy as defined in claim 2 wherein:

the power-unit has an audio speaker electrically connected to a third power-unit contacting means;

the toy-unit controlling means includes an audio speaker control circuit electronically connected to a third toy-unit contacting means; and wherein when the toy-unit is received by the power-unit, the third toy-unit electrical contacting means is electrically contacted with the third power-unit electrical contacting means.

4. A portable toy as claimed in claim 3 wherein:

the power-unit has a beep-tone circuit electrically connected to a fourth power-unit contacting means;

the toy-unit controlling means includes a beep-tone circuit control circuit electronically connected to a fourth toy-unit contacting means; and when the toy-unit is received by the power-unit, the fourth toy-unit electrical contacting means is electrically contacted with the fourth power-unit electrical contacting means.

5. A portable toy as claimed in claim 4 wherein: the power-unit has a power-unit flashing circuit speaker electrically connected to a fifth power-contacting unit contacting means;

the toy-unit controlling means includes a power-unit flashing circuit control circuit electronically connected to a fifth toy-unit contacting means; and when the toy-unit is received by the power-unit, the fifth toy-unit electrical contacting means is electrically contacted with the fifth power-unit electrical contacting means.

6. A portable toy as defined in claim 5 wherein the mechanical energy source is an electric -motor and the electrical energy source is at least one battery.

7. A portable toy as defined in claim 6 wherein there are two batteries and the first battery is located at an anterior position on the power-unit chassis and the second battery is located at a posterior position on the power-unit chassis.

8. A portable toy as defined in claim 7 wherein the power-unit chassis is inverted-"U"-shaped in transverse cross-section and the motor is positioned in a first finger of the "U".

9. A power-unit for use with a portable toy capable of playing, at different times, different, interchangeable, electro-mechanical toy-units, comprising:

a power-unit chassis;

an electrical energy source;

a mechanical energy source energized by the electrical energy source;

first power-unit mechanical energy transferring means for transferring mechanical energy from the mechanical energy source to a first power-unit mechanical energy coupling means;

first power-unit electrical energy contacting means;

first power-unit electrical energy conducting means for conducting electrical energy from the electrical energy source to the first power-unit electrical contacting means;

toy-unit receiving means for removably receiving one toy-unit at a time which may be selected from a plurality of different, interchangeable, electro-mechanical toy-units wherein the toy-unit receiving means includes removably securing means for interacting with the toy-unit to removably secure the toy-unit to the power-unit; and a releasably-connecting means for releasably connecting the power-unit to a wrist of a user; and wherein the toy-unit comprises:

a toy-unit chassis;

first, mechanical toy-element visible from outside the toy-unit chassis;

first toy-unit mechanical energy coupling means;

first toy-unit mechanical energy transferring means for transferring mechanical energy from the first toy-unit mechanical energy coupling means to the first mechanical toy-element for imparting mechanical movement to the first toy-element;

toy-unit controlling means for user-controlling at least a part of the mechanical movement of the first toy-element;

first toy-unit electrical contacting means; and first toy-unit electrical conducting means for conducting electrical energy from the first toy-unit electrical contacting means to the toy-unit controlling means; and wherein the power-unit has a configuration and the toy-unit has a configuration such that when the toy-unit is removably received by the power-unit:

the first toy-unit mechanical energy coupling means is mechanically coupled to the first power-unit mechanical energy coupling means; and the first toy-unit electrical energy contacting means is electrically contacted with the first power-unit electrical energy contacting means.

10. A power-unit as defined in claim 9 wherein:

the toy-unit controlling means includes power-on/off electrical control circuitry electrically connected to a second electrical contacting means;

the power-unit has a second power-unit electrical contacting means electrically connected to power-on/off electrical control circuitry for controlling the energization of the mechanical energization means by the electrical energy source; and the configurations of the power-unit and the toy-unit are such that, when the toy-unit is received by the power-unit, the second toy-unit electrical contacting means is electrically contacted with the second power-unit electrical contacting means.

11. A power-unit as claimed in claim 10 wherein:

the power-unit has an audio speaker electrically connected to a third power-unit contacting means;

the toy-unit controlling means includes an audio speaker control circuit electronically connected to a third toy-unit contacting means; and wherein when the toy-unit is received by the power-unit, the third toy-unit electrical contacting means is electrically contacted with the third power-unit electrical contacting means.

12. A power-unit as claimed in claim 11 wherein:

the power-unit has a beep-tone circuit electrically connected to a fourth power-unit contacting means;

the toy-unit controlling means includes a beep-tone circuit control circuit electronically connected to a fourth toy-unit contacting means; and when the toy-unit is received by the power-unit, the fourth toy-unit electrical contacting means is electrically contacted with the fourth power-unit electrical contacting means.

13. A power-unit as claimed in claim 12 wherein:

the power-unit has a power-unit flashing circuit speaker electrically connected to a fifth power-unit contacting means;

the toy-unit controlling means includes a power-unit flashing circuit control circuit electronically connected to a fifth toy-unit contacting means; and when the toy-unit is received by the power-unit, the fifth toy-unit electrical contacting means is electrically contacted with the fifth power-unit electrical contacting means.

14. A power-unit as claimed in claim 13 wherein the mechanical energy source is an electric motor and the electrical energy source is at least one battery.

15. A power-unit as claimed in claim 14 wherein there are two batteries and the first battery is located at an anterior position on the power-unit chassis and the second battery is located at a posterior position on the power-unit chassis.

16. A power-unit as claimed in claim 15 wherein the power-unit chassis is inverted-"U"-shaped in transverse cross-section and the motor is positioned in a first finger of the "U".

* * * * *